United States Patent [19]

Harmon et al.

[11] Patent Number: 5,062,582

[45] Date of Patent: Nov. 5, 1991

[54] APPARATUS AND METHOD FOR PRODUCING SEMI-CONVERTED DISKETTE LINERS

[75] Inventors: Thomas D. Harmon, Woburn; Kenneth G. Morrison, Hanover, both of Mass.

[73] Assignee: International Paper Company, Purchase, N.Y.

[21] Appl. No.: 388,455

[22] Filed: Aug. 2, 1989

[51] Int. Cl.[5] ..... B65H 35/02; B65H 35/04; B26D 5/20

[52] U.S. Cl. ..... 242/56.4; 242/56.8; 242/75.51; 83/27; 83/102; 83/237; 83/650

[58] Field of Search ..... 242/56.8, 56.4, 56.5, 242/76, 75.51; 226/20; 83/23, 27, 31, 102, 107, 237, 650

[56] References Cited

U.S. PATENT DOCUMENTS

| | | | |
|---|---|---|---|
| 1,172,068 | 2/1916 | Spiegel . | |
| 1,296,934 | 3/1919 | Drouilly . | |
| 1,389,645 | 9/1921 | Hudson . | |
| 2,127,960 | 8/1938 | Piazze . | |
| 2,240,139 | 4/1941 | Kaailau . | |
| 2,258,428 | 10/1941 | Stalder . | |
| 2,316,283 | 4/1943 | Piperoux . | |
| 2,494,018 | 1/1950 | Urquhart . | |
| 2,789,640 | 4/1957 | Belden . | |
| 3,113,741 | 12/1963 | Herr | 242/56.8 |
| 3,144,216 | 8/1964 | Billingsley . | |
| 3,178,979 | 4/1965 | Lyon . | |
| 3,194,095 | 7/1965 | Buck . | |
| 3,240,851 | 3/1966 | Scalora . | |
| 3,360,210 | 12/1967 | Frisbie | 242/56.8 X |
| 3,398,614 | 8/1968 | Cleary . | |
| 3,491,437 | 1/1970 | Small . | |
| 3,496,815 | 2/1970 | Ruhl . | |
| 3,581,389 | 6/1971 | Mori et al. | 242/56.8 X |
| 3,762,250 | 10/1973 | Huskey | 83/27 |
| 4,021,031 | 5/1977 | Meihofer et al. | 226/20 |
| 4,163,180 | 7/1979 | Dowd | 242/75.51 |
| 4,317,399 | 3/1982 | Romagnoli | 83/237 |
| 4,346,855 | 8/1982 | Biggar | 242/76 X |
| 4,395,929 | 8/1983 | Moser | 83/686 |
| 4,419,913 | 12/1983 | Schutt | 83/27 |
| 4,508,282 | 4/1985 | Eiting | 242/56.5 X |
| 4,628,780 | 12/1986 | Hicks | 83/99 |
| 4,681,004 | 7/1987 | Waldner | 83/98 |
| 4,694,717 | 9/1987 | Boots | 83/222 |
| 4,773,293 | 9/1988 | Mizuta | 83/39 |
| 4,898,569 | 2/1990 | Focke et al. | 242/56.8 |
| 4,913,015 | 4/1990 | Tone | 83/650 X |

*Primary Examiner*—John M. Jillions

*Attorney, Agent, or Firm*—Walt Thomas Zielinski

[57] ABSTRACT

An apparatus and method for manufacturing partially cut (semi-converted) products in continuous roll form has input feeds for supplying a continuous web of material and a continuous transport web in parallel, feed rollers for incrementally advancing the two webs together to a cutting station where product units are partially cut in successive increments in a continuous strip, a scrap remover, and a station for winding up the cut product strip. The webs are unwound and the cut product strip is wound via dancer bars maintaining constant tension. The input webs have a width which is a multiple of the width of the product units so that multiple strips can be formed simultaneously. The invention is used to form semi-converted, micro diskette liners having connecting portions and indented cutouts marking the boundaries between units. The cutouts are overcut in one direction and also in an intersecting direction to obtain complete cuts despite slight variations in registration.

15 Claims, 2 Drawing Sheets

APPARATUS AND METHOD FOR PRODUCING SEMI-CONVERTED DISKETTE LINERS

TECHNICAL FIELD

This invention generally relates to an apparatus and method for efficiently producing a high volume of cut products in continuous strip or roll form, and more particularly, for producing continuous rolls of diskette liners.

BACKGROUND ART

In conventional manufacturing equipment for producing products from sheets of paper, fiber, fabric, and the like, it is highly advantageous to have a manufacturing process that is substantially continuous and automated in order to produce a high output of products at efficient speeds. A particular example is the manufacturing of liners for floppy magnetic disks. Heretofore, such liners have been produced by cutting out individual liner units from a continuous sheet of nonwoven fibrous material, as shown, for example, in U.S. Pat. No. 4,681,004 issued to Waldner on July 21, 1987. The volume of output can be improved, as shown in U.S. Pat. No. 4,773,293 issued to Mizuta et al. on Sept. 27, 1988, by cutting the liner units through two sheets stacked on top of each other. The separated liner units are then assembled with other required components into diskette units.

However, it is found that the above-described conventional production of liners and assembly of diskette units has the disadvantage that the separated liner units require complex piece-wise handling once they are cut from the sheet so that the speed and efficiency of production of the liners is limited by the requirements of the downstream assembly of diskettes. In addition, the difficulty in cutting the liners cleanly poses a reliability problem that could interrupt the entire production line.

It has therefore been desired to have the liners produced in continuous roll form, so that they can be supplied as inputs to separate assembly lines for the diskettes. The production of partially cut products in continuous roll form entails the technical problems of obtaining clean incremental cuts of the products in a strip, supporting the strip of cut products so that it does not tear during processing, ensuring that the product units can be separated accurately later despite errors in cutting or processing, and winding up the strip of cut products in a continuous roll without distortion, creasing or tearing.

DISCLOSURE OF INVENTION

An apparatus of the invention for manufacturing cut-out products in continuous roll form, comprises: a first input roll feed for supplying a continuous web of material from which the products are to be made; a second input roll feed for supplying a transport web for supporting the continuous web of product material thereon in parallel therewith along a machine direction; an input pair of feed rollers for incrementally advancing the two webs together to a cutting station; the cutting station having a die cutter for cutting through the product and transport webs to form partially cut product units in successive increments with respective connecting portions between increments for keeping the products units joined together in a continuous strip; scrap removal means for separating the transport web and cuttings from the strip of cut products; a finished-product guide for transporting the strip of cut products to a windup station; and the windup station having a spool on which the cut product strip is wound together with an interleaving film as an output product roll.

In the preferred form of the invention, the product web and transport web are unwound from the roll feed under constant tension, and dancer bars are provided to provide take-up lengths for the webs to accomodate the incremental advancing of the webs to the cutting station. A plastic film unwinding sheet is wound with the continuous strip of cut products to facilitate unwinding of the product roll without tearing. An optical-servo web guide system maintains center-line tracking of the webs. The input webs can have a width which is a multiple of the width of the product units so that multiple strips of products can be cut simultaneously therefrom. The multiple output strips are separated and wound at separate winding stations. For the particular application of the invention to diskette liners, the production line includes static eliminators and an ionized air blower.

Another aspect of the invention comprises the continuous strip having connecting portions provided with indented cutouts formed on respective lateral edges of the connecting portions in a direction transverse to the machine direction. The die cutter of the cutting station includes a trailing blade portion which overcuts the indented cutouts in one cut direction, and a leading blade portion which overcuts the indented cutouts in another cut direction intersecting that of a preceding cut of the trailing blade portion, in order to complete cuts despite slight variations in registration. The invention encompasses the methods for forming continuous roll product related to the above-described apparatus.

Other objects, features, and advantages of the present invention are explained in the following detailed description of the best mode of carrying out the invention, considered with reference to the accompanying drawings.

BEST MODE FOR CARRYING OUT THE INVENTION

The invention is applicable generally to an apparatus and related method for manufacturing partially cut (semi-converted) products from a continuous web in continuous roll form, and specifically to the manufacture of semi-converted diskette liners for use in making micro floppy diskettes. Decribed herein is a preferred embodiment of the invention for the manufacture of continuous rolls of diskette liners in which a wide input sheet is used to form a plurality of liner output rolls in tandem. The principles of the invention can be applied equally as well to other applications in which discrete product units are cut from a continuous web and wound up as one or more output product roll(s) for use in further manufacturing or assembly processes.

Figure 1:
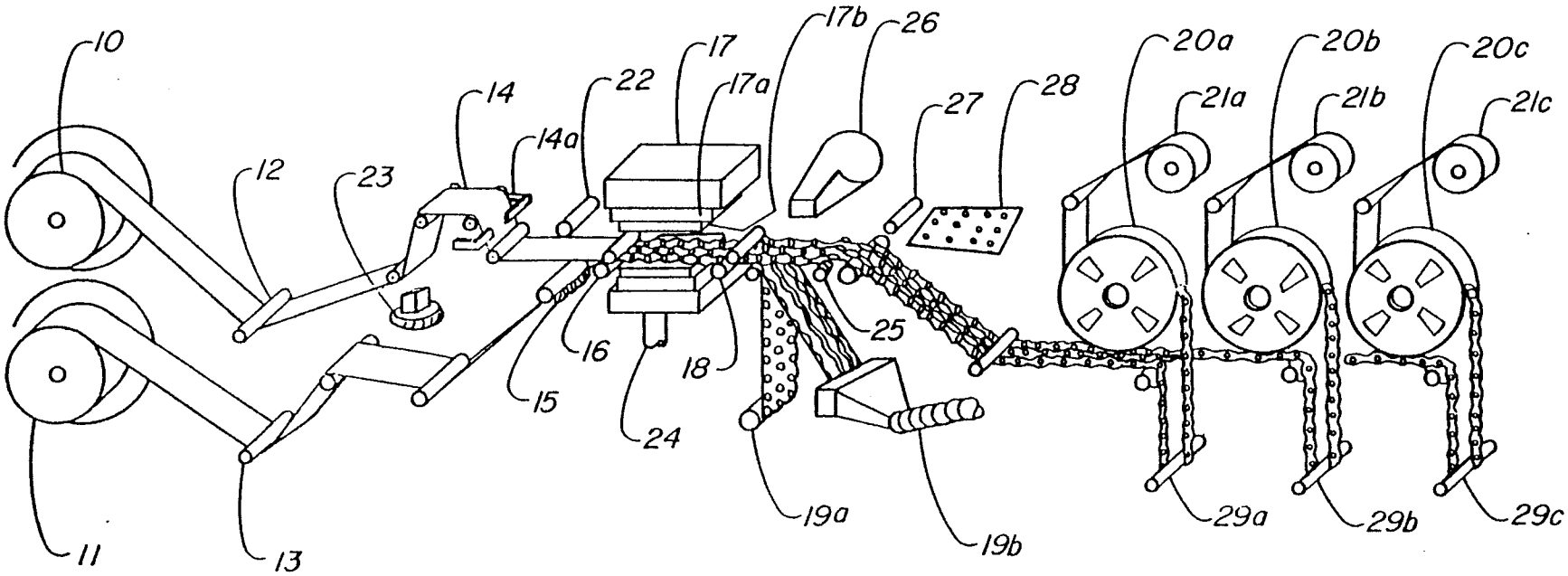
FIG. 1 is a schematic diagram on a preferred embodiment of a continuous roll product production line in accordance with the principles of the invention.

Referring to FIG. 1, an apparatus for producing continuous roll liner includes a first input roll feed 10 for supplying a continuous web of non-woven product material, a second input roll feed 11 for supplying a transport web for supporting the product web, a first dancer bar 12 for the product web, a second dancer bar 13 for the transport web, a web guide system 14 for the product web, a web guide 15 for the transport web, a pair of input feed rollers 16 for incrementally advancing the two webs together, a cutting station 17 having a die cutter, a pair of output feed rollers 18, a scrap rewind 19*a* for removing the transport web scrap, a scrap remover 19*b* for removing the edge cuttings and other scrap, and output windup spools 20*a*, 20*b*, and 20*c*.

In the example of continuous roll liner production, the product web is an 11.875 inch wide web of non-woven fabric suitable for the liner material. The liner web is unwound under substantially constant tension, e.g. about 300 grams, provided by the dancer bar 12. The dancer bar uses a take-up length of liner web to accomodate the incremental advances of the liner web to the cutting station 17 in order to avoid having to stop and start the liner input roll feed 10.

The liner web is guided to the input feed rollers 16 by means of an optical-servo guide system using a guide sensor 14*a* for center-line tracking. The optical-servo guide system operates using two optical detectors each located along an edge of the web so as to track the position of the web edge and relay information to a signal processor. The processor compares the information to previously set edge positions. If correction is necessary, the processor sends an actuating signal to an actuator which adjusts the position of a roller-equipped steering carriage on which the web passes. Such a unit is made by Fife Corp., Model type OPG-LRB. For treatment of the liner fabric, an ionizing static eliminator 22 and a cold-steam humidifier 23 conditions the non-woven fabric web before it enters the nip of the input feed rollers 16 to aid in downstream scrap removal, as is known in the industry.

Concurrently, 50 lb. kraft paper, also 11.875 inch wide, is unwound under constant tension, e.g. 450 grams, by means of the dancer bar 13. The paper acts as a transport medium which minimizes wrinkling and facilitates the die cutting process by insuring complete penetration through the liner fabric. The paper is edge guided into the input feed rollers 16 by a convex surface web guide having a radius of curvature selected to maintain web rigidity and prevent web climbing on the guide.

The liner and kraft paper webs are brought together in parallel at the input feed rollers 16 and fed therethrough along a machine direction. Pneumatic loading can be used to provide the requisite force to insure proper traction. The input feed rollers 16 are electronically indexed to advance the webs by an incremental amount. In the case of liners units having a length in the machine direction of 3.425 inches, an index length of two full pitches, i.e. 6.850 inches is nominally selected. The input feed rollers are driven by high resolution stepper motors controlled and adjusted through a computer unit.

Figure 2A:
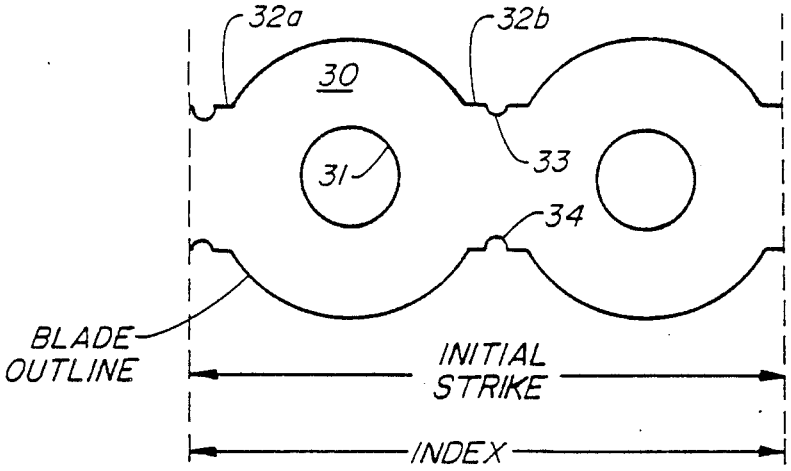
FIG. 2A is a schematic diagram of an incremental cut performed by a die cutter at the cutting station of the production line of FIG. 1.
Figure 2B:
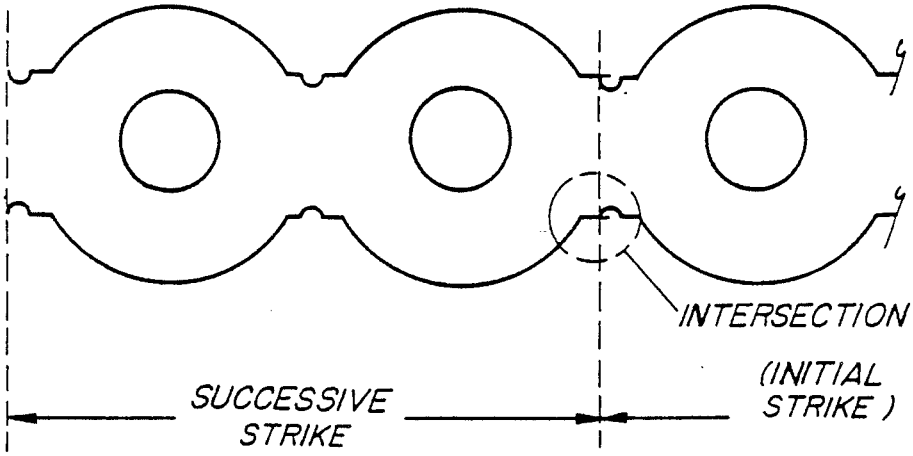
FIG. 2B shows a successive cut performed so as to overlap slightly with the previous cut.

In this example, the liner and kraft paper have a width selected to accomodate the cutting of three separate strips of liner units side by side. Each strip consists of a series of liner units in the machine direction. The liner units each have the shape, as shown in FIGS. 2A and 2B, of a circular disk 30 with a central hole 31 and connecting portions 32*a*, 32*b* on each side in the machine direction. The boundary between adjacent liner units is marked by a pair of indented cutouts 33, 34 on each lateral edge of the adjacent connecting portions in a cross direction transverse to the machine direction. During subsequent floppy disk assembly, each liner unit is separated from the strip along a transverse out marked by the indented cutouts.

With each incremental advance of the two webs by the index length, the die cutter at cutting station 17 is pressed down to cut completely through the liner and partially through the kraft paper webs against a hardened steel anvil. The die cutter is preferably a 20 ton press and has a steel rule die 17*b* with three sets of blades, having a blade outline for each strip as shown in FIG. 2A, and six cavities (three strips with two liner units each) for cutting the central holes 31. A scrap manifold 17*a* is housed in the reciprocating head of the cutter for removal of the circular scrap which is blown upwards through the head by air nozzles located in the anvil. The scraps are evacuated out through vacuum ducting. Air to the anvil nozzles is supplied by the air nozzle assembly 24 indicated in FIG. 1. The head travel is limited by internal stops that determine the depth of the head movement. The head is then returned up to allow the next index length of the webs to be advanced.

Figure 3:
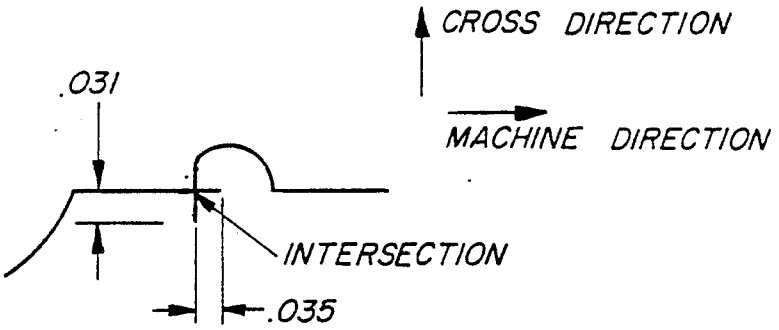
FIG. 3 shows a detail of the intersection of the previous and successive cuts of FIGS. 2A and 2B which allows for slight variation in registration of the cuts.

During the cutting process, slight variations in the guiding of the webs to the cutting station and registration of the webs with the cutting head may occur. Such variations can result in a slight offset from one incremental strike of the cutter blades to the next. In order to ensure that the cut-out liner strips are completely severed from the liner web from one cutter strike to the next, the invention provides for the indented cutouts to be located at the boundary between successive cuts, and a leading and trailing blade configuration which has a predetermined amount of overcutting to accomodate anticipated variations of up to 0.030 inch. As shown more clearly in FIGS. 2B and 3, the cut at the corner of the indented coutout by a trailing blade portion on a previous strike overlappingly intersects the cut of a leading blade portion on a successive strike, e.g. by about 0.035 inch in the machine direction and 0.031 inch in the cross direction. Thus, a complete cut of the corners of the indented cutouts will be made despite variations of up to 0.030 inch in either direction.

After each indexed cut, the output feed rollers 18 draw the three cut product strips out of the die in synchronization with advancing of the webs by the input feed rollers 16. A differential index can be provided between input and output rollers to control the tension on the cut product strips by computer control. Differential roller indexing allows the output feed roller (and the finished product rollers) to be rotated in greater (or lesser) amounts during each index cycle. The difference in rotation (number of degrees) determines the tension on the web. Without this, normal stretch of the material would cause a slack condition between the sets of rollers, leading to inaccurate punching, misregistration, and potential jamming. A differential roller index is obtainable through Preco Industries, which is also a manufacturer of a punch press as mentioned above. It is controlled by the single-board computer that controls the press operation.

The three liner product strips are separated from the kraft paper web by the scrap rewind 19*a* applying a constant torque. The kraft paper cannot be reused, and is either scrapped or sold as salvage. The liner scrap (edge trims) is evacuated through the scrap removal plenum 19*b* and ducted to a central scrap location. The remaining liner strips are then indexed by way of the finished product feed rollers 25 which are operated in synchronization with the input and output feed rollers. The product is anti-static treated by the ionized air blower 26 and static eliminator 27. Successive liner strips may be spliced together to maintain a continuum. The location of the splice is important to the later assembly process, and must be positioned such that an optical detector on the assembly machine can detect its position. A splicing table (indicated by numeral 28) is provided to allow splices to be located in the proper position, while ensuring that the pitch accuracy is not affected.

The finished product strips are then separated and wound on respective spools 20*a*, 20*b*, 20*c*. In order to allow continuous winding on the spools, the strips are run under constant tension by respective dancer rolls 29*a*, 29*b*, 29*c*. Because the punching rate of the press is constant and the spool diameter changes as more material is wound, the speed on the spools is decreased as the material accumulates. The speed of each spool is controlled by the height of the respective dancer (higher-slower, lower-faster). The speed control is handled by a potentiometer through a gearbox whose input is directly coupled to the dancer arm. Such a dancer control is the Series 1000 which is commercially available through Chase Machine Co., Warwick, Rhode Island. This arrangement provides uniform tensioning (e.g., 7–15 grams) through the spools, thereby eliminating dimensional distortions due to stretching and product creases from internal buckling. The strips may be interleaved with polyethylene films dispensed under uniform tension from rolls 21*a*, 21*b*, 21*c* along with the liner strips. The interleaved films are provided to facilitate and prevent tearing of the strips during unwinding.

A typical die press station can be operated at the rate of about 60 strokes per minute. With six product units (three strips with two pitches each) cut per stroke, 360 units can be formed per minute. For a typical nonwoven fabric roll of the 11.875 inch width, three spools of continuous roll liners are formed each containing about 9000 liner units.

Industrial Applicability

From the foregoing description, it will be recognized by those skilled in the art that the present invention is capable of use in industry to provide a continuous roll of product units, or multiple rolls in tandem, cut from a continuous sheet or web. The invention ensures that the cut product strips are not distorted or torn and have complete cuts formed at their incrementally indexed boundaries. The use of the variable control dancer loops ensures uniform tensioning and improved tracking. The synchronized input, output, and finished product feed roller system allows the webs and output strips to be indexed smoothly and continuously through direct nip rollers controlled with programmable acceleration, duration, and deceleration profiles. This system is not influenced by web texture or slippage. The cut product strips are wound continuously through variable speed rewind controlled by dancer loops, thereby ensuring a uniform tensioning.

Numerous modifications and variations are of course possible given the above disclosure of the principles and mode of carrying out the invention. It is intended that all such modifications and variations be considered as within the spirit and scope of the invention, as defined in the following claims.

We claim:

1. An apparatus for manufacturing cut products in continuous roll form, comprising:

a first unwind feed for supplying a continuous web of material from which the products are to be made along a machine direction;

a second unwind feed for supplying a transport web for supporting the continuous web of product material thereon in parallel therewith along the machine direction;

an input pair of feed rollers for incrementally advancing the two webs together to a cutting station;

a first input dancer bar positioned between the first unwind feed and the input feed rollers around which the product web is run with a given take-up length such that the product web is unwound from the first unwind feed and fed by the input feed rollers to the cutting station under substantially constant tension, and a second input dancer bar positioned between the second unwind feed and the input feed rollers around which the transport web is run with a given take-up length such that the transport web is unwound from the second unwind feed and fed by the input feed rollers to the cutting station under substantially constant tension;

the cutting station having a die cutter for cutting through the product and transport webs to form cut product units in successive increments and respective connecting portions between increments for keeping the products units joined together in a continuous strip;

scrap removal means for separating the transport web and scrap material of the continuous web of product material from the strip of cut products;

an output pair of feed rollers positioned at an output end of the cutting station and indexed with the input feed rollers for incrementally transporting the strip of cut products to a windup station;

the windup station having a spool on which the cut product strip is wound as an output product roll; and an output dancer bar positioned between the output feed rollers and the windup station around which the cut product strip is run with a given take-up length such that the cut product strip is fed by the output feed rollers from the cutting station and wound up on the windup spool under substantially constant tension.

2. An apparatus according to claim 1, wherein said input and output pairs of feed rollers are incrementally indexed in synchronism with each other.

3. An apparatus according to claim 1, wherein said windup station includes a further spool supplying a winding sheet which is interleaved with the cut product strip to facilitate unwinding thereof.

4. An apparatus according to claim 1, further comprising a product web guide for guiding the product web to the cutting station in registration therewith.

5. An apparatus according to claim 4, wherein said product web guide is an optical-servo system which maintains center-line tracking of the web.

6. An apparatus according to claim 1, wherein said spool is wound with a winding speed which is variably controlled by the position of the output dancer bar.

7. An apparatus according to claim 1, wherein said die cutter includes a cutter head and an anvil against which the cutter head cuts the webs, and an air nozzle assembly located in the anvil and a scrap manifold in the cutter head for air blown removal of scrap.

8. An apparatus according to claim 1, wherein the product web has a width in a direction perpendicular to the machine direction sufficient for forming a plurality of cut product strips in tandem, said die cutter is configured with a plurality of cutter units to cut said plurality of strips in tandem, said output dancer bar includes a corresponding plurality of output dancer bar elements each for running a respective one of the cut product strips, and said winding station includes a corresponding plurality of spools each for winding a respective one of the cut product strips.

9. An apparatus according to claim 1, wherein said product units are liners for floppy magnetic disks, said product web is a non-woven fabric web, and said die cutter is configured to cut the liner units with a circular portion, a central hole, and connecting portions on each side of the circular portion in the machine direction.

10. An apparatus according to claim 9, wherein said die cutter is further configured to cut indented cutouts on respective lateral edges between connecting portions of adjacent liner units in a cross direction transverse to the machine direction.

11. An apparatus according to claim 10, wherein said die cutter is further configured with a trailing blade portion which overcuts the indented cutouts between the connecting portions in one cut direction, and a leading blade portion which overcuts the indented cutouts in another cut direction intersecting that of a preceding cut of the trailing blade portion, in order to provide complete cuts despite slight variations in registration.

12. A method for manufacturing cut products in continuous roll form, comprising:

supplying from a first unwind feed a continuous web of material from which the products are to be made along a machine direction;

supplying from a second unwind feed a transport web for supporting the continuous web of product material thereon in parallel therewith along the machine direction;

incrementally advancing the two webs together by an input pair of feed rollers to a cutting station;

providing a first input dancer bar positioned between the first unwind feed and the input feed rollers around which the product web is run with a given take-up length such that the product web is unwound from the first unwind feed and fed by the input feed rollers to the cutting station under substantially constant tension, and providing a second input dancer bar positioned between the second unwind feed and the input feed rollers around which the transport web is run with a given take-up length such that the transport web is unwound from the second unwind feed and fed by the input feed rollers to the cutting station under substantially constant tension;

cutting with a die cutter at the cutting station through the product and transport webs to form cut product units in successive increments with respective connecting portions between increments for keeping the products units joined together in a continuous strip;

separating the transport web and scrap material of the continuous web of product material from the strip of cut products;

incrementally transporting the strip of cut products from the cutting station to a windup station by an output pair of feed rollers indexed with the input feed rollers;

winding the cut product strip on a spool at the windup station as an output product roll; and providing an output dancer bar positioned between the output feed rollers and the windup station around which the cut product strip is run with a given take-up length such that the cut product strip is fed by the output feed rollers from the cutting station and wound up on the windup spool under substantially constant tension.

13. A method according to claim 12, wherein said winding step includes interleaving a winding sheet with the cut product strip to facilitate unwinding thereof.

14. A method according to claim 12, wherein said winding step includes variably controlling the winding speed of the spool by the position of the output dancer bar.

15. A method according to claim 12, wherein the supplying step includes supplying a product web that has a width in a direction perpendicular to the machine direction sufficient for forming a plurality of cut product strips in tandem, the cutting step includes cutting with a die cutter having a plurality of cutter units to cut the plurality of strips in tandem, the second providing step includes providing a corresponding plurality of output dancer bar elements each for running a respective one of the cut product strips, and the winding step includes using a corresponding plurality of spools each for winding a respective one of the cut product strips.

* * * * *